US005676426A

United States Patent [19]

Herring

[11] Patent Number: 5,676,426

[45] Date of Patent: Oct. 14, 1997

[54] SAFETY HARNESS FOR RESTRAINING A CHILD

[75] Inventor: Steven J. Herring, Virginia Beach, Va.

[73] Assignee: Vel-Tye, L.L.C., Virginia Beach, Va.

[21] Appl. No.: 584,424

[22] Filed: Jan. 11, 1996

[51] Int. Cl.[6] ..... A47D 15/00

[52] U.S. Cl. ..... 297/484; 297/485; 297/DIG. 6; 128/875; 119/770

[58] Field of Search ..... 297/468, 484, 297/485, DIG. 6; 128/875, 876, 846; 119/770, 907; 24/306

[56] References Cited

U.S. PATENT DOCUMENTS

| | | | |
|---|---|---|---|
| 1,930,378 | 10/1933 | Beagan | 247/484 |
| 2,132,556 | 10/1938 | Blackshaw | 297/484 |
| 2,877,833 | 3/1959 | Boles | 297/485 |
| 3,466,090 | 9/1969 | Posey | 297/484 |
| 3,612,605 | 10/1971 | Posey, Jr. | 297/484 |
| 4,666,017 | 5/1987 | Zimmerman . | |
| 4,834,460 | 5/1989 | Herwig | 297/485 |
| 4,867,464 | 9/1989 | Cook . | |
| 4,898,185 | 2/1990 | Fuller | 297/485 X |
| 4,911,105 | 3/1990 | Hocum | 128/876 X |
| 5,056,869 | 10/1991 | Morrison . | |
| 5,069,168 | 12/1991 | Roberson et al. . | |
| 5,119,767 | 6/1992 | Jimenez . | |
| 5,136,759 | 8/1992 | Armour, II | 24/306 X |
| 5,325,818 | 7/1994 | Leach . | |

*Primary Examiner*—Peter R. Brown
*Attorney, Agent, or Firm*—Pollock, Vande Sande & Priddy

[57] ABSTRACT

A safety harness comprising a waist strap for placement around the waist of a child, right and left shoulder straps for placement over corresponding shoulders of the child and for crossing each other over the chest of the child, and an anchor strap with distal fastening elements for securing the harness to restrain the child. Each shoulder strap has a proximate end fixedly secured to the waist strap in spaced relation to the proximate end of the other shoulder strap, and a distal end with a securing loop adapted to be received on and to slide along a corresponding attachment section of the waist strap. The attachment sections have cooperative facings of hook and loop materials on opposite sides of the waist strap adjacent to front free ends such that overlapping and pressing the attachment sections together while the securing loops are received thereon releasably joins together the free ends to form a continuous waist strap with the shoulder straps connected thereto.

19 Claims, 2 Drawing Sheets

FIG. 4
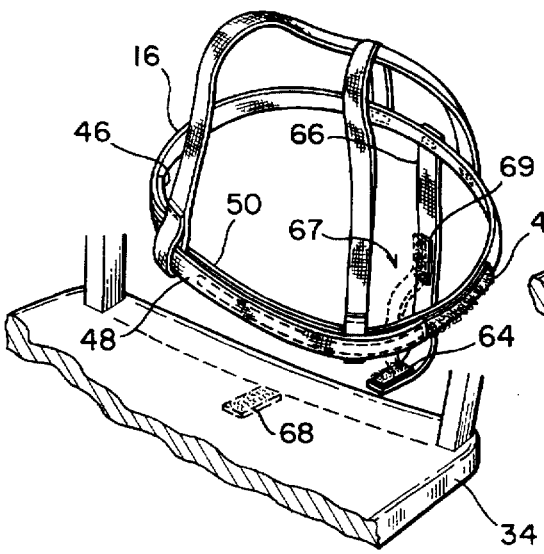
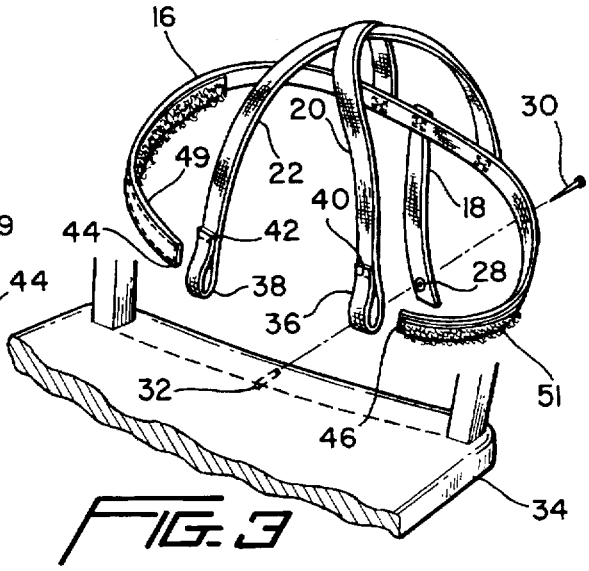
FIG. 3
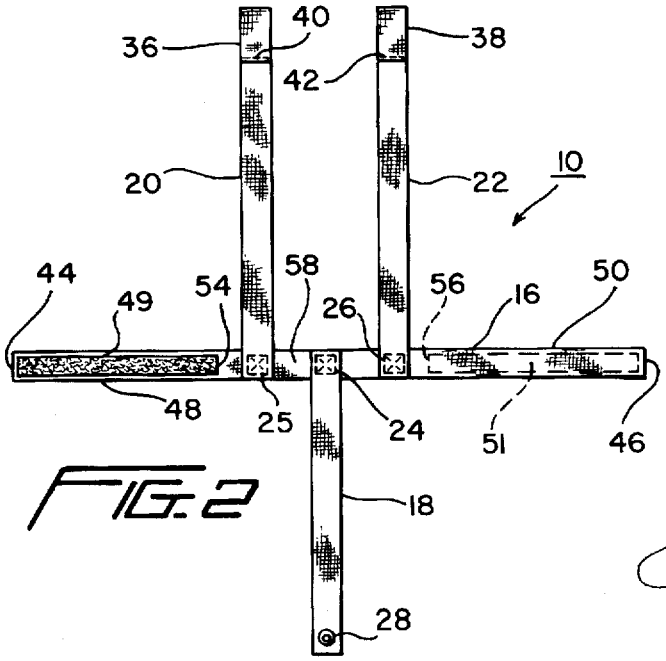
FIG. 2
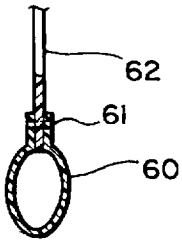
FIG. 5
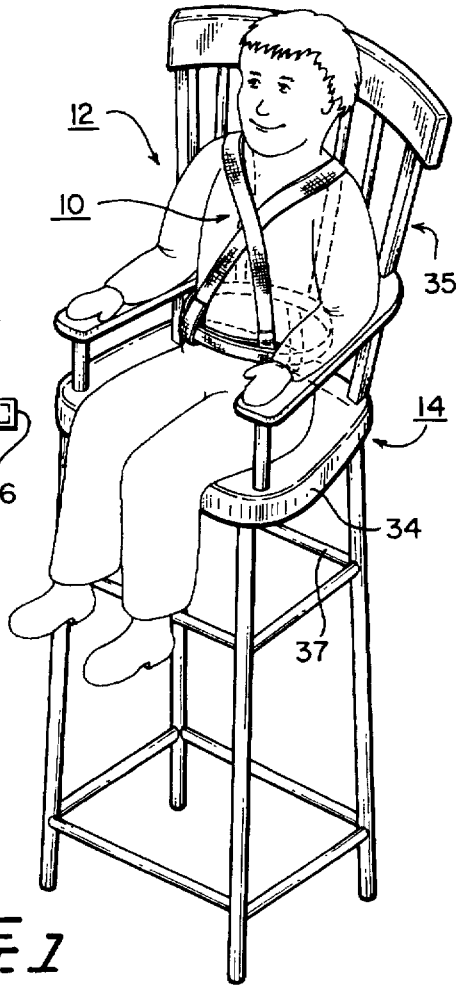
FIG. 1

SAFETY HARNESS FOR RESTRAINING A CHILD

FIELD OF THE INVENTION

This invention relates generally to child restraining devices, and more particularly to a safety harness for restraining a child, such as in a seat structure like a chair or shopping cart.

BACKGROUND OF THE INVENTION

The need to restrain children in a high chair or a shopping cart, or when they are ambulatory, for their own safety is well known and a variety of restraining devices have been used in the past for these purposes. However, many restraining devices used in the past are not suitable for use with presently available high chairs and/or shopping carts. In addition, some prior restraining devices use a multiplicity of complicated straps and buckles that makes them cumbersome and difficult to use and expensive to make. Other prior restraining devices are not effective because they can be released or removed too easily by the child, or they cause discomfort while in use, or they can not be released and removed quickly from the child in case of an emergency.

Accordingly, a need exists for a restraining harness for children which is economical to manufacture and is readily adaptable to restrain a child in a modern high chair or shopping cart, and which effectively and comfortably restrains a child from falling out of a chair or shopping cart or when a child is ambulatory.

SUMMARY OF THE INVENTION

The foregoing disadvantages of prior art restraining devices are overcome by the present invention which provides a rugged, lightweight, low-cost, easily installed, and easily used safety harness for restraining a child in a chair or shopping cart, or for controlling a child's ambulatory movements. The harness fits snugly across the child's shoulders and chest and encircles the child's waist, thereby restraining the child's forward, lateral and upward movements. It is simple in construction and is easily and quickly applied to restrain the child, and is easily released for removal of the child, either in ordinary circumstances or during an emergency.

Briefly, the safety harness of the invention includes a waist strap which is adapted to encircle the waist of a child. The waist strap is provided with two free ends toward the front and with adjacent, relatively long attachment sections, which are adapted to be overlapped adjacent to the front and side portions of the waist of the child. The attachment sections are provided with facings of hook and loop type of fastening materials, such that when the attachment sections are overlapped, cooperative facings are opposite each other and may be pressed together to engage each other to form a continuous waist strap. Preferably, the hook and loop facings are substantially elongated along the length of the attachment sections to permit the waist strap to be adjusted to the size of the child's waist, and also to cooperate with loop members at the distal ends of right and left shoulder straps as described in more detail below.

The harness includes right and left shoulder straps each adapted to extend over a corresponding shoulder of the child and having a proximate end fixedly secured to the waist strap in spaced relation to the proximate end of the other shoulder strap. At or near the distal end of each shoulder strap is a loop member adapted to be received on and to slide along a corresponding one of the attachment sections of the waist strap. The shoulder strap loops are arranged relative to the hook and loop facings on the waist strap such that when the latter extends around the waist of the child and each shoulder strap extends over a corresponding shoulder of the child, these loops may be trapped between engaged portions of the hook and loop facings to releasably lock the shoulder loops in a desired fixed position along the length of the waist strap, such as near the transition between the front and side portions of the waist of the child.

An anchor strap has a proximate end secured near the middle of the waist strap so as to be positioned adjacent to the rear portion of the waist of the child, and a distal end with a securing means for fixedly or detachably securing the harness to the seat or to some other component of the chair or shopping cart, such as a horizontal bar, rail or stretcher member. The distal end may be modified to provide a harness for controlling a child's ambulatory movements. The proximate end of the anchor strap is preferably secured to the waist strap between the respective proximate ends of the shoulder straps.

The securing means at the distal end of the anchor strap may take a variety of forms depending on the type of chair or cart member to which it is to be fixedly or detachably connected. For example, the distal portion of the anchor strap may contain an aperture for receiving an embedded type of fastener, such as a screw, nail or rivet, having one end adapted to be embedded in a seat, rail or cross bar and the other end provided with a head for clamping against the rim of the aperture to fixedly secure the anchor strap. Alternatively, hook and loop fastening materials may be used to detachably secure the distal end of the anchor strap, such as by securing a patch of hook or loop material to a surface of the seat with an adhesive and providing a cooperating patch of hook or loop material on a distal end portion of the anchor strap. As another alternative, a distal end portion of the anchor strap may be in the form of a securing loop placeable around a horizontal rail, cross bar or stretcher member, or capable of being gripped by the hand of an adult in the case of an ambulatory child.

Instead of using patches or elongated Segments (strips) of hook and loop materials, a preferred embodiment of the invention utilizes a product known as one-wrap, which is sold under the brand name ULTRAMATE (Product No. RM888L361) by Velcro USA, Inc. One-wrap is characterized by having all loop material (Loop 1000) on one side and all hook material (Hook 088) on the other side of the strap. For economy of manufacture and versatility of application, one-wrap is preferably used for the waist strap, and also for the anchor strap where the means for securing the anchor strap to the chair or shopping cart is to include hook and loop materials as described elsewhere in this specification.

Although in the specific examples described in this specification, one facing may be shown as loop material and the opposing facing may be shown as hook material, it is to be understood that the fastening engagement will be achieved by reversing these facings. Accordingly, when the term "hook or loop material" is used in this specification, it means that either facing is of hook material and the opposing facing is of loop material, i.e., the opposing facings have cooperating forms of the material, one with loops and the other with hooks.

Prior to use, the safety harness of the invention may be either fixedly secured to a chair or shopping cart by an embedded fastener, such as a screw, nail, rivet or the like, or detachably secured by a clamp or by one of the VELCRO hook and loop type of fasteners described elsewhere in this specification. In using the safety harness as thus secured, each shoulder strap is drawn over the child's corresponding shoulder and placed diagonally downwardly across the front of the child. The loops at the distal ends of these straps are slipped over the free ends of the waist strap, the right shoulder strap loop being slipped over the left free end of the waist strap and the left shoulder strap loop being slipped over the right free end of the waist strap.

The respective shoulder strap loops are then slipped along the corresponding attachment sections until the shoulder straps make a snug fit across the child's shoulders, while at the same time each shoulder strap loop remains within the boundaries of the corresponding attachment section on which there exists a facing of hook or loop material. Thereafter, the waist strap is drawn around the child's waist with the desired degree of tightness and the attachment sections thereof are overlapped and pressed together to engage the cooperative hoop and loop materials thereon. This action locks each shoulder strap loop in position with hook and loop materials engaged on each side thereof, and also forms a continuous waist strap that makes a snug fit around the child's waist so that the child is effectively, yet comfortably, restrained.

By reason of the longitudinal extent of the overlapped attachment sections of the waist strap and the capability of trapping the strap loops at different locations therebetween, both the tightness of the waist strap and the tightness of the shoulder straps are adjustable so that the safety harness of the invention may comfortably fit children of a wide range of ages and sizes. Furthermore, the safety harness is quickly applied to and released from the child without moving the child's head or arms. It is also adapted to be secured to a variety of different parts of a chair or shopping cart, and therefore is adaptable for use with a wide variety of both older and modern types of ordinary chairs, high chairs and shopping carts.

BRIEF DESCRIPTION OF THE DRAWINGS

The invention and its structure, operation and advantages may be further understood from the detailed description below of specific embodiments taken in conjunction with the accompanying drawings, in which:

FIG. 1 is a perspective view illustrating the safety harness of the invention as used to restrain a child in a high chair;

FIG. 2 is a plan view of the safety harness of FIG. 1 when removed from the child and laid on a flat surface;

FIG. 3 is a perspective view of the safety harness of FIG. 2 in a partially assembled condition;

FIG. 4 is a perspective view of a modification of the safety harness of the invention in a completely assembled condition, except for attachment of the anchor strap to the chair;

FIG. 5 is a sectional view showing details of a modification in the loop at the distal end of each shoulder strap of the safety harness of the invention;

DETAILED DESCRIPTION OF THE PREFERRED EMBODIMENTS

Figure 6:
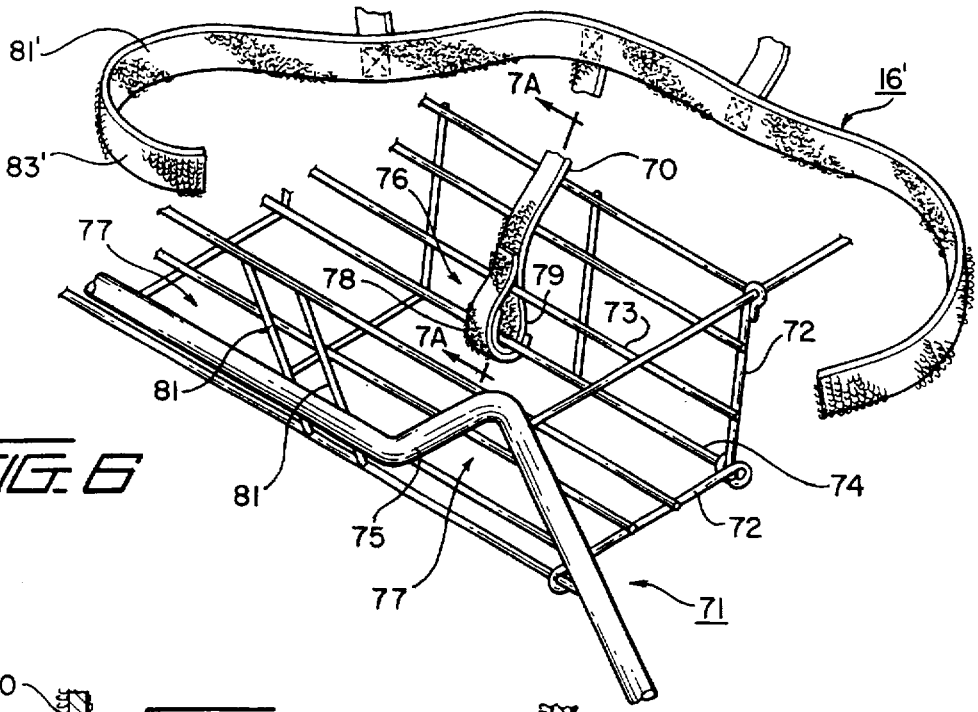
FIG. 6 is a perspective view illustrating a modification of the anchor strap to provide for attachment of the safety harness of the invention to a shopping cart or some other seat structure with a horizontal member; and, FIG. 7A is a sectional view taken along lines 7A—7A of FIG. 6 illustrating structural details of the distal end portion of the anchor strap.

Referring now to the drawings, and particularly to FIGS. 1–3, there is shown a preferred form of the safety harness of the invention, generally designated 10, for restraining a child 12, in a high chair 14. The harness 10 comprises a waist strap 16, an anchor strap 18, a right shoulder strap 20 and a left shoulder strap 22. The proximate ends of the anchor strap and the right and left shoulder straps are fixedly secured to waist strap 16, such as by respective box stitching 24, 25 and 26. Near the distal end of anchor strap 18 is an aperture formed by a grommet 28 through Which may be passed a screw, nail, rivet or the like for fixedly securing or "anchoring" the anchor strap to the seat or a back cross rail (stretcher) of the chair 14.

As shown by way of example in FIG. 3, a screw 30 is passed through the aperture of the grommet 28 and embedded in a predrilled hole 32 in the rear of chair seat 34. The chair 14 also has a back structure 35 which may include a horizontal cross rail or stretcher (not shown) above the seat 34 to which the anchor strap 18 may be attached by screw 30. Anchor strap 18 may be made longer and attached in a similar fashion to a cross rail 37 below seat 34. In addition, seat 34 may be made of a modern plastic material and have a downwardly extending skirt (not shown) around the bottom edge thereof to which the anchor strap 18 may be attached by a metal rivet passing through the grommet 28 and a hole in the plastic skirt.

At the distal ends of shoulder straps 20 and 22 are respective securing loops 36 and 38 formed by folding a distal end portion of each strap back upon itself and securing the fold with stitching 40 and 42, respectively. Securing loops 36 and 38 are sized to fit over and slide along corresponding attachment sections of waist strap 16, as illustrated best in FIGS. 3 and 4. Thus, loop 38 of left shoulder strap 22 passes over the right free end 44 of waist strap 16, and loop 36 of right shoulder strap 20 passes over the left free end 46 of waist strap 16.

Extending along the inner surface of a right attachment section 48 of waist strap 16 from adjacent to its right free end 44 is an inner facing 49 of hook or loop material, and extending along the outer surface of a left attachment section 50 of waist strap 16 from adjacent to its left free end 46 is an outer facing 51 of cooperating hook or loop material. To avoid having hook material catch on or snag the fabric of a child's clothing, the inner facing 49 is preferably loop material and the outer facing 51 is preferably of hook material. Accordingly, when the attachment sections 48 and 50 are overlapped and pressed together as shown in FIG. 4, the facings 49 and 51 will engage each other in well know fashion such that waist strap 16 will be continuous.

Although in the example shown, the inner facing 49 is of loop material and the outer facing 51 is of hook material, it is to be understood that the fastening engagement will be achieved by reversing the facings such that the inner facing is of hook material and the outer facing is of loop material. Accordingly, when the term "hook or loop material" is used in this specification, it means that one facing is of hook material and the opposing facing is of loop material, i.e., the opposing facings have cooperating forms of the material, one with loops and the other with hooks. Furthermore, the facing 51 may be on the outer side of attachment section 48 and the facing 49 may be on the inner side of attachment section 50, such that the overlap between sections 48 and 50 would be the reverse of that shown in FIG. 4.

Another important feature of the invention is that the longitudinal extent of both the facing 49 and the facing 51 is preferably of sufficient length to provide engagement between the cooperating hook and loop materials for a substantial distance on each side of the likely position in which loops 36 and 38 are to be placed along the length of waistband 16, such that the loops 36 and 38 are locked in a fixed position along the length of waistband 16 by the engaged portions of the facings 49 and 51 as shown best in FIG. 4. In other words, when the facings 49 and 51 are overlapped and pressed together with a portion of each of the loops 36 and 38 placed therebetween as shown in FIG. 4, the engaged hook and loop segments on each side of the shoulder strap loops 36 and 38 lock these loops in a fixed position along the length of waist strap 16.

The facings 49 and 51 are shown in FIG. 2 as being provided respectively by elongated strips 54 and 56 of hook and loop materials sewn to a backing of nylon material 58. The strips 54 and 56 may be made from one-sided hook and loop materials available from Velcro USA, Inc., such as a one-sided loop material product designated as Loop 1000 and a one-sided hook material product designated as Hook 088. As a preferred alternative, the entire waist strap 16 may be of a uniform material having all hooks on one side and all loops on the opposite side, one such material being known as "one-wrap" and being available from Velcro USA, Inc., under the product name ULTRAMATE and Product No. RM888L361.

Referring now to FIG. 5, there is shown an alternative way in which to form the shoulder strap loops 36 and 38 wherein a separate piece 60 of flexible plastic material, such as clear vinyl of density 3H, is folded in half and then stitched, such as by box stitching 61, to the distal end of a shoulder strap 62. The shoulder strap 62 is preferably made from a different flexible synthetic material, more preferably a product known as Nylon Grograin.

Figure 7A:
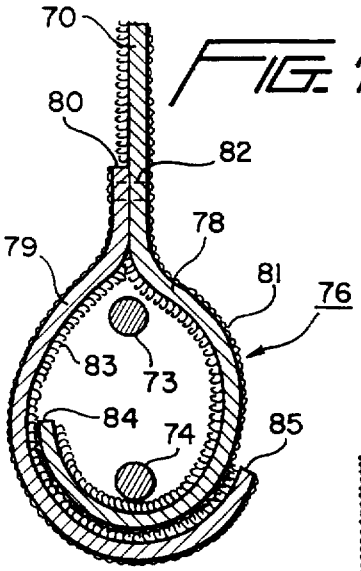
FIGS. 7B, 7C and 7D are sectional views illustrating alternative embodiments of the distal end portion of the anchor strap to provide for its attachment to a shopping cart or some other seat structure with a horizontal member as shown in FIG. 6.
Figure 7B:
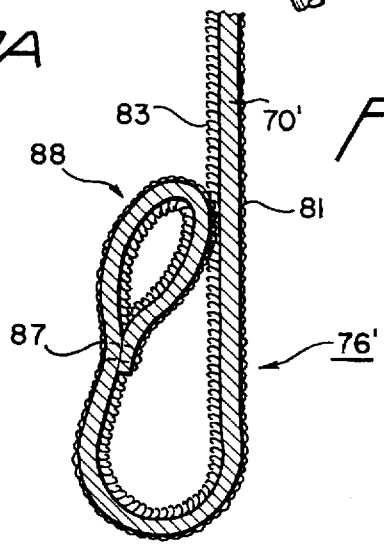
Figure 7C:
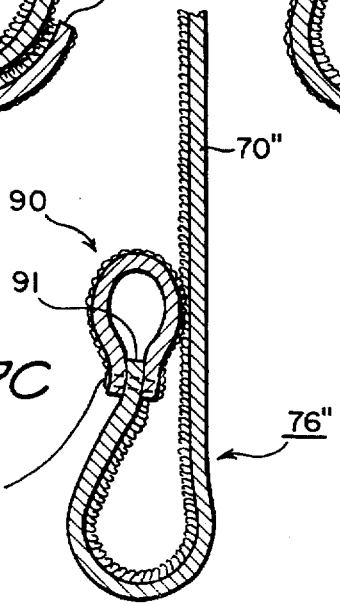
Figure 7D:
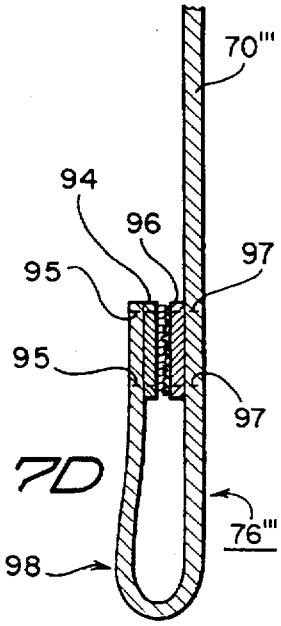

There are shown in FIG. 4 and in FIGS. 6–7D alternative ways in which the anchor strap 18 may be attached to a chair or shopping cart without the use of an embedded fastener, which must pass into or through the material of the chair or shopping cart as described above in connection with FIG. 3. In FIG. 4, a patch 64 of hook or loop material is shown stitched or otherwise fixedly secured to a distal portion of an anchor strap 66, in which position it may detachably engage a cooperating patch 68 of hook or loop material fixedly secured to the bottom of chair seat 34. Alternatively, a distal end portion of anchor strap 66 may be folded back upon itself as indicated by broken lines 67 so that patch 64 may detachably engage an alternate patch 69 of hook or loop material fixedly secured to an intermediate segment of anchor strap 66 to form an anchor loop 67 for engaging a stretcher member of a chair or a cross-rod of a shopping cart as described more fully in connection with FIGS. 6–7D.

The patch 68 is preferably secured to the bottom surface of seat 34 by an adhesive on a smooth side opposite to a facing of hook or loop material. More preferably, patch 68 is made from a VELCRO product with a self-adhering backing called a "sticky back", this product being available as Hook 088 S/B or Loop 1000 S/B. Most preferably, patch 68 is made from Hook 088 S/B and patch 64 is made from Loop 1000, a segment of which is sewn to the distal end portion of anchor strap 66.

In FIG. 6, there is illustrated an anchor strap 70 having an anchor loop 76 for securing the safety harness 10 to the seat of a shopping cart, generally designated 71, formed from a plurality of rods, such as side rods 72, back rods 73, and seat rods 74. The shopping cart has a rear handle 75 that is pushed by a shopper, such that the child faces rearwardly with his or her back against the back rods 73 and his or her legs passing through openings 77, 77 on either side of two vertical crotch rods 81, 81.

In this embodiment, the securing means for the anchor strap 70 comprises the anchor loop 76, which is formed from opposing distal end segments 78 and 79 that are placed around opposite sides of one of the back rods 73 and one of the seat rods 74. Respective free ends 84 and 85 of segments 78 and 79 are then overlapped and pressed together as shown best in FIG. 7A. As shown in this figure, the anchor strap 70 is preferably made from one-wrap material having a facing 81 of loops all along one side and a facing 83 of hooks all along the opposite side. The waist strap 16' also may be made from one-wrap material having a facing 81' of loops all along the inside and a facing 83' of hooks all along the outside.

The anchor loop 76 is preferably made by folding back upon itself a distal end portion of the strap 70 to create a loop larger than the anchor loop 76, and then fastening the previously free end 80 to an intermediate segment of the strap 70 by stitching, such as a box stitch 82. The bottom of the resulting larger loop (not shown) is then cut to provide new free ends 84 and 85, which may then be overlapped as shown in FIG. 7A to create the somewhat smaller anchor loop 76 for surrounding and engaging one or more cross bars, rods, rails, stretchers, or the like.

A similar anchor loop (not shown) may be made by making the strap 70 from a material having a single facing of hook or loop material and then stitching an elongated segment of cooperating hook or loop material on the opposite side of the strap to create a cooperating segment equivalent to the segment 79 of one-wrap material shown in FIG. 7A. The advantage of using one-wrap material with hook and loop facings on both sides, instead of material with a single facing of hook or loop material, is that the resulting distal end segments 78 and 79 may be overlapped from either direction, i.e., either segment may form the outer layer or the inner layer of the overlapped portions thereof.

Referring now to FIG. 7B, there is shown another way in which an anchor loop may be formed at the distal end of an anchor strap 70' made from one-wrap material. In this embodiment, an anchor loop 76' is formed at the distal end of anchor strap 70' by folding back a small segment of the one-wrap material and stitching it at 87 to form a permanent attaching loop 88 of relatively small size, but capable of engaging the hook surface 83 of the strap 70'.

In FIG. 7C, there is shown an anchor loop 76" at the distal end of an anchor strap 70". In this embodiment, a small attaching loop 90 is formed by folding in half a separate short segment of loop material and attaching by stitching 92 the opposite ends thereof to opposite sides of the distal end 91 of the strap 70". In this embodiment, the anchor strap 70" is made from material with a single facing of hook or loop material, and the attaching loop 90 is also made from a material with a single facing of cooperative hook or loop material.

In FIG. 7D, there is shown a further way in which to create an anchor loop at the distal end of an anchor strap using materials with a single facing of hook or loop material. In this embodiment, an-anchor loop 76'" is formed by first securing as by sewing, two separate and cooperative patches of hook or loop material to the same side of an anchor strap 70"' made from a flexible plastic or fabric material without a hook and loop facing. Thus, a first patch 94 of hook material is secured by stitching 95, 95 to a distal end segment of the strap 70"' and a second patch 96 of loop material is secured by stitching 97, 97 to an intermediate segment of the strap 70"' such that a distal section 98 of strap 70"' may be folded back upon itself to create the anchor loop 76"' as shown in FIG. 7D. In this and the other embodiments of the anchor loop, the cooperative hook or loop material of the respective facings are placed in opposing relation and then pressed together to cause the usual type of engagement between facings of hook and loop materials as illustrated in diagrammatic fashion in FIGS. 4 and 6–7D.

The preferred hook and loop materials used in making the safety harness of the present invention are products available from VELCRO USA, Inc. If it is desired to use for the waist strap and the anchor strap materials having a single facing of hook or loop material, the preferred loop material is available as Loop 1000 and the preferred hook material is available as Hook 088. The most preferred material for the waist strap 16 and the anchor strap 18 is one-wrap sold under the mark ULTRAMATE (Product No. RM888L361). When used for the waist strap and anchor strap, the one-wrap is arranged so that the hook side faces outwardly and the loop side faces inwardly toward the child so that the clothing of the child will move smoothly against the inside surface of the waist strap and anchor strap. This would not be the case if the hook side were facing inward because the hook material has a tendency to snag the fabric of clothing.

Depending on the size of the child for which the safety harness is to be used, the length of the waist strap is preferably in the range of 25 to 36 inches and the length of the anchor strap is in the range of 9 to 12 inches. Both the waist strap and the anchor strap preferably have a width of about 1 inch. Where the grommet 28 is used for securing the anchor strap, the anchor strap is preferably made from one inch wide Nylon Grogain material.

The shoulder straps 20 and 22, as well as the shoulder strap 62 (FIG. 5), are also preferably made from a one inch wide Nylon Grogain material. Depending on the size of the child, each shoulder strap has a length preferably in the range of 24 to 36 inches. As previously described, the loops 36 and 38 at the distal ends of the shoulder straps 20 and 22 may be made by folding back and stitching a distal end portion of the Nylon Grogain material as may be seen best in FIG. 3. Where the shoulder strap loop is made from a relatively short segment (about 3 inches long) of a different material as shown in FIG. 5, the material of the short segment is preferably clear flexible vinyl plastic having a density designated in the trade as 3H.

Prior to use, the safety harness of the invention is firmly secured to a chair or shopping cart by an embedded fastener, such as a screw 30 as shown in FIG. 3, or by one of the VELCRO hook and loop type fasteners shown in FIGS. 4 and 6–7D. In using the safety harness as thus secured, the shoulder straps 20 and 22 are drawn over the child's corresponding shoulders and placed diagonally downwardly across the chest of the child and the loops 36 and 38 at the distal ends thereof are slipped respectively over the free ends 46 and 44 of the waist strap 16. In other words, the right shoulder strap loop 36 is slipped over the left free end 46 of the waist strap, and the left shoulder strap loop 38 is slipped over the right free end 44 of the waist strap.

The shoulder strap loops 36 and 38 are then slipped longitudinally along the attachment sections 50 and 48, respectively, until the shoulder straps make a snug fit across the child's shoulders, while at the same time each shoulder strap loop remains well within the boundaries of the hook and loop facing of the corresponding attachment section of the waist strap. Thereafter, the waist strap is drawn around the child's waist with the desired degree of tightness and the attachment sections 48 and 50 are overlapped and pressed together to engage the cooperative hook and loop materials thereon. This action locks the shoulder strap loops 36 and 38 in a fixed position with hook and loop materials engaged on each side thereof, and also forms a continuous waist strap that makes a snug fit around the child's waist as shown in FIGS. 1 and 4. The child is thereby effectively, yet comfortably, restrained in a chair or shopping cart by the fully assembled safety harness 10.

While the invention has been described in conjunction with the preferred embodiments thereof, many changes, modifications, alterations and variations will be apparent to those skilled in the art when they learn of the invention. Thus, although the invention is described in conjunction with restraining a child in a high chair or shopping cart, it is also applicable to safety harnesses for restraining children in other situations. For example, the safety harness of the invention can easily be modified for use to restrain and guide a child when the child is ambulatory, such as when the child is walking with the parent in a store or shopping mall. For this use, the anchor strap 18 would be replaced by a tether of greater length, at the far end of which would be a loop, similar to anchor loop 76, that would be gripped by the hand of the parent to restrain and guide the child during his or her ambulatory movement.

Accordingly, the preferred embodiments of the invention shown in the drawings and described in detail above are intended to be illustrative, not limiting, and various changes may be made without departing from the spirit and scope of the invention as defined by the claims set forth below.

What is claimed is:

1. A safety harness for restraining a child, said harness comprising:

a waist strap adapted to extend around the waist of the child and having attachment sections adjacent to opposite free ends of said waist strap;

right and left shoulder straps-each adapted to extend over a corresponding shoulder of the child and having a proximate end fixedly secured to said waist strap in space relation to the proximate end of the other shoulder strap; and an anchor strap having a proximate end secured to said waist strap between the proximate ends of said shoulder straps, and a-distal end with securing means for securing said harness to restrain the child;

each of the distal ends of said shoulder straps comprising a loop adapted to be received on and to slide along a corresponding one of said attachment sections of said waist strap and each of said attachment sections comprising a facing of hook or loop material, said hook and loop facings being cooperative and positioned on opposite sides of said waist strap such that overlapping and pressing together said attachment sections while said shoulder loops are received thereon releasably joins together said free ends to form a continuous waist strap with the distal ends of said shoulder straps secured to said continuous waist strap, said hook and loop facings being elongated so as to extend longitudinally along said attachment sections and being arranged relative to said shoulder strap loops such that, when said shoulder straps extend over the respective shoulders of the child and said waist strap extends around the waist of the child, said shoulder strap loops may be trapped between engaged portions of said hook and loop facings to releasably lock said loops in fixed positions along the length of said continuous waist strap, and said fixed positions being variable such that said safety harness can be adjusted to fit children of different sizes.

2. The safety harness of claim 1 wherein the lengths of said shoulder straps are substantially equal and said lengths are sufficient for said shoulder straps to be crossed over the chest of the child at the time said shoulder strap loops are locked in fixed positions along the length of said waist strap.

3. The safety harness of claim 1 for restraining the child in a seat structure, wherein said securing means comprises an aperture in a distal end portion of said anchor strap for receiving a fastener capable of engaging said seat structure to secure said harness to said seat structure.

4. The safety harness of claim 1 for restraining the child in a seat structure, wherein said securing means comprises a patch of hook or loop material attached to said anchor strap and a cooperating patch of hook or loop material capable of being attached to said seat structure to secure said harness to said seat structure.

5. The safety harness of claim 4 wherein said cooperating patch has hook or loop material on one side and an opposite side capable of being adhered to a surface of said seat structure by an adhesive material.

6. The safety harness of claim 5 wherein the opposite side of said cooperating patch has a covering of said adhesive material which forms a sticky backing capable of being adhered to said seat structure.

7. The safety harness of claim 1 for restraining a child in a seat structure having a member traversing at least a portion of said seat structure wherein said securing means comprises a first anchor facing of hook or loop material on a distal end portion of said anchor strap and a second anchor facing of cooperating hook or loop material arranged on the distal end portion of said anchor strap in spaced relation to said first anchor facing such that said first and second anchor facings may be overlapped and pressed into engagement with each other to form a continuous anchor loop capable of extending around and engaging said traversing member to secure said harness to said seat structure.

8. The safety harness of claims 7 wherein the distal end portion of said anchor strap comprises first and second anchor segments each having a corresponding one of said anchor facings of hook or loop material, a free end, and a base end connected to the remainder of said anchor strap, said anchor facings being positioned on opposite sides of said anchor segments such that overlapping and pressing together said anchor segments releasably joins together the free ends thereof to form said continuous anchor loop.

9. The safety harness of claim 8 wherein each of said anchor segments is made of one-wrap material having all hooks on one side and all loops on the opposite side.

10. The safety harness of claim 7 wherein said first and second facings are provided by respective first and second patches of hook or loop material attached to said distal end portion in spaced relation to each other such that said anchor facings may be overlapped and engaged when said distal end portion is folded back upon itself.

11. The safety harness of claims 7 wherein said first facing is provided by an end loop of hook or loop material of a size smaller than the size of said anchor loop and formed from an end segment of said distal portion, and wherein said second facing is provided by hook or loop material on an intermediate segment of said distal end portion such that said anchor facings may be overlapped and engaged when said distal end portion is folded back upon itself.

12. The safety harness of claim 11 wherein said distal end portion is formed from continuous one-wrap material with all hooks on one side and all loops on the opposite side, and wherein said end loop is formed from an end segment of said continuous one-wrap material folded back upon itself.

13. The safety harness of claim 11 wherein said end loop is formed from a separate segment of flexible material separate from a main segment of anchor strap material, and wherein said separate segment is folded back upon itself and has respective ends fixed to an end part of said main segment.

14. The safety harness of claim 13 wherein the material of said separate segment has a different composition from the anchor strap material of said main segment.

15. The safety harness of claim 1 wherein said waist strap is formed from continuous one-wrap material with all hooks on one side and all loops on the opposite side.

16. The safety harness of claim 1 wherein said shoulder strap is formed from a continuous length of flexible material, and wherein said shoulder strap loop is formed from an end segment of said continuous material folded back upon itself and having a distal end fixed to an intermediate segment of said continuous material.

17. The safety harness of claim 1 wherein said shoulder strap loop is formed from a separate segment of flexible material separate from a main segment of shoulder strap material, and wherein said separate segment is folded back upon itself and has respective ends fixed to an end part of said main segment.

18. The safety harness of claim 17 wherein the shoulder strap material of said separate segment has a different composition from the shoulder strap material of said main segment.

19. The safety harness of claim 18 wherein the material of said separate segment is a clear plastic.

* * * * *